United States Patent [19]

Ucci et al.

[11] Patent Number: 4,501,591

[45] Date of Patent: Feb. 26, 1985

[54] PROCESS FOR CONVENIENTLY PROVIDING STAIN-RESISTANT POLYAMIDE CARPETS

[75] Inventors: Pompelio A. Ucci, Pensacola; Randolph C. Blyth, Gulf Breeze, both of Fla.

[73] Assignee: Monsanto Company, St. Louis, Mo.

[21] Appl. No.: 626,259

[22] Filed: Jun. 29, 1984

Related U.S. Application Data

[63] Continuation-in-part of Ser. No. 565,439, Dec. 27, 1983, abandoned.

[51] Int. Cl.[3] ..... D06P 1/56; D06P 3/24; D06P 1/673

[52] U.S. Cl. ..... 8/495; 8/560; 8/632; 8/929; 427/393.4

[58] Field of Search ..... 8/495, 560, 632, 929

[56] References Cited

U.S. PATENT DOCUMENTS

| | | | |
|---|---|---|---|
| 3,416,878 | 12/1968 | Biber | 8/632 |
| 4,295,852 | 10/1981 | Walz et al. | 8/685 |
| 4,302,202 | 11/1981 | Sumner et al. | 8/560 |

*Primary Examiner*—Maria Parrish Tungol
*Attorney, Agent, or Firm*—John W. Whisler

[57] ABSTRACT

The invention relates to an improvement in certain processes for continuously dyeing polyamide carpets whereby stain resistance is imparted to the carpets during the dyeing process. The improvement involves adding an alkali metal silicate (e.g. sodium meta silicate) and a sulfonated phenol-formaldehyde condensation product to the dye liquor used in the dyeing process. If either the silicate or condensation product is omitted from the liquor, the improvement is not achieved. The improvement provides a convenient and economical means for providing stain resistant polyamide carpets.

10 Claims, No Drawings

PROCESS FOR CONVENIENTLY PROVIDING STAIN-RESISTANT POLYAMIDE CARPETS

BACKGROUND OF THE INVENTION

This application is a continuation-in-part of copending application Ser. No. 565,439, filed Dec. 27, 1983 now abandoned.

FIELD OF THE INVENTION

This invention relates to an improvement in processes for continuously dyeing polyamide carpets whereby stain resistance is imparted to the carpets during the dyeing process.

The term polyamide carpet as used herein means a carpet having a pile consisting essentially of polyamide fibers.

The term fiber as used herein includes fibers of extreme or indefinite length (i.e. filaments) and fibers of short length (i.e., staple). The term yarn, as used herein, means a continuous strand of fibers.

The term stain resistant carpet as used herein means a carpet the pile of which has the ability to resist staining when subjected to the Stain Resistance Test given hereinafter. Briefly, the test is accomplished by immersing a test sample of the carpet in a solution containing Food Drug and Cosmetics (FD&C) Red Dye No. 40. If the dye fails to visibly stain the carpet under the test conditions, the carpet is stain resistant.

DESCRIPTION OF THE PRIOR ART

Polyamide carpet is a popular floor covering for both residential and commercial applications. Such carpeting is relatively inexpensive and offers a desirable combination of qualities, such as aesthetics, comfort, safety, warmth and quietness. Also, it is available in a wide variety of attractive colors, patterns and textures. However, polyamide carpet is permanently stained by certain artificial and natural colorants, for example, colorants present in coffee, red wine and soft drinks. One such colorant is FD&C Red Dye No. 40, a dye Federally approved for human consumption and commonly used in foods and beverages, such as soft drink packaged premixes and gelatin desserts, for the purposes of imparting a red color to such foods and beverages.

The usual commercial approach to minimizing staining of polyamide carpet has been to coat the polyamide fibers, either before or after the carpet is made, with a fluorochemical to prevent wetting of the carpet surface and thus minimize contact between the staining substance (i.e., colorant) and the carpet surface. This approach, however, offers very little protection to the carpet in instances where the staining substance is not immediately removed from the carpet. Surveys of the carpet replacement market show that more carpets are replaced due to staining than due to wear. Therefore, there is a need in the art to provide a stain resistant polyamide carpet having the ability to retain its original appearance for a longer period of time.

SUMMARY OF THE INVENTION

The present invention provides a means for imparting stain resistance to polyamide carpet during the dyeing of the carpet. More specifically, the present invention provides an improvement in certain processes for continuously dyeing a polyamide carpet whereby stain resistance is imparted to the carpet as the carpet is being dyed. In the continuous dyeing process of the type to which the present invention is an improvement, an endless length of carpet having a pile consisting essentially of polyamide fibers is passed through a treating zone in which the carpet is: first, prewetted; then, treated with an aqueous medium containing dye and dye auxiliaries (i.e. liquor) in an amount such that the liquor ratio is in the range of 1.5:1.0 to 4.0:1.0; next, subjected to an atmosphere of steam to fix the dye on the carpet; then, washed with water to remove residual liquor from the carpet; and, finally, dried. The improvement provides a convenient and inexpensive means for imparting stain resistance to the carpet and comprises adding (1) a silicate of the formula $M_2O.m(SiO_2)$ where M is an alkali metal and m is a number ranging from about 0.5 to 2.0 and (2) a sulfonated phenol-formaldehyde or naphthol-formaldehyde condensation product to the liquor with each being added in an amount sufficient in combination to provide stain resistant carpet. By liquor ratio is meant the weight ratio of aqueous medium (liquid) to carpet (goods). By sulfonated phenol-formaldehyde or naphthol-formaldehyde condensation product is meant that the product contains sulfonic acid groups (i.e., $—SO_3H$) or a salt thereof (e.g., an alkali metal salt) attached to carbon atoms of the phenolic or naphtholic groups. The sulfonated condensation product preferably is prepared by reacting one or more phenols or naphthols with formaldehyde in an appropriate mole ratio, wherein at least one of the phenols or naphthols contains sulfonic acid groups (i.e. $—SO_3H$) or a salt thereof (e.g. the ammonium or alkali metal salt) attached directly to carbon atoms of the phenol or naphthol. Alternatively, an unsulfonated phenol or naphthol may be reacted with formaldehyde in an appropriate mole ratio to provide a condensation product that is subsequently sulfonated by the treatment with fuming sulfuric acid.

Polyamide carpet dyed in accordance with the improvement of the invention has pile fibers which are coated and impregnated with the condensation product. The resulting carpet, however, does not contain a significant amount, if any, of the silicate; the silicate is removed from the carpet during the dyeing process, specifically, when the carpet is washed to remove residual liquor. Surprisingly, however, if the silicate is omitted from the liquor, the improvement is not realized, that is, a stain resistant carpet is not provided.

Since the condensation product coats and also impregnates the pile fibers, polyamide carpet treated in accordance with the improvement of the present invention can be sheared in a conventional manner (i.e., as the last step in the carpet making process) to provide a cut pile carpet in which the freshly exposed pile fiber ends are stain resistant without further treatment. This is important since further treatment of the carpet after the shearing step to achieve stain resistance of the exposed ends would add significantly to the overall cost of the carpet and, therefore, be undesirable.

The improvement of the invention does not require additional processing steps or equipment and is conveniently practiced by merely adding appropriate amounts of the silicate and condensation product to the liquor in the same way that dye auxiliaries are added to the liquor.

Sulfonated phenol-formaldehyde condensation products of the type useful for practicing the improvement are commercially available from Crompton and Knowles under the tradename Intratex ®N and from Ciba-Geigy under the tradename Erional ®PA and Erional ®NW.

PREFERRED EMBODIMENTS OF THE INVENTION

Conventionally, the continuous dyeing process to which the present invention relates is practiced by continuously passing an endless length of carpet through a dyeing unit, such as a dyeing unit (range) commercially available from the Otting Company or Kuster Corporation. The endless length of carpet consists of lengths of carpet of a selected width (e.g. a 12-foot/3.7-meter width) sewn together end-to-end. The carpet is passed through the unit by means of a conveyor (e.g. tenter frame) on which the carpet rests or rides. In passing through the unit the carpet is first prewetted, for example, by passing through a trough of water to which has been added a wetting agent. The carpet is then passed between a pair of nip rolls to squeeze excess water from the carpet after which the carpet is passed into contact with liquor, i.e. an aqueous medium containing dye and dye auxiliaries. The pH of the liquor is typically in the range of 4.5 to 8. The liquor is metered onto the carpet to provide a liquor ratio ranging from about 1.5:1.0 to 4.5:1.0. The liquor is typically applied to the carpet by overhead nozzles from which the liquor is sprayed onto the carpet or by a doctor blade from a reservoir of the liquor. Next, the carpet passes through a festoon steamer or similar vessel where the dye is fixed onto the carpet by means of contact with steam. The carpet is then passed from the festoon and washed, for example, by being passed into contact with jets of water and mechanical scrubbers which remove residual liquor from the carpet. Excess water is typically removed from the carpet by, first, passing the carpet over a perforated steel plate while a vacuum is applied from beneath the plate and, then passing the carpet from the plate through an oven where the moisture content of the carpet is reduced to an acceptable level.

In practicing the continuous dyeing process described above in accordance with the improvement of the invention, sulfonated condensation product and silicate are each added to the liquor in an amount sufficient in combination to impart stain resistance to polyamide carpet during the dyeing thereof. Typically, a sufficient amount of condensation product is an amount in excess of about 0.1% by weight, based on the weight of fiber (i.e., o.w.f.), with amounts ranging from 0.2% to 1.5% o.w.f. being preferred. At higher concentrations, the fibers tend to become stiff and impart a harsh and undesirable hand to the carpet.

Sulfonated condensation products useful in practicing the improvement of the invention are preferably linear, low molecular weight condensation products, that is, products having an average molecular weight of less than about 1000, for example, in the range of 250 to 700. Such products are water-soluble and may be prepared by conventional art-recognized techniques, for example, by condensation of formaldehyde with one or more phenols in a mole ratio of about 1.0 to 0.8, phenol(s) to formaldehyde, at a pH of less than 7 using an acid catalyst such as HCl, wherein at least one of the phenols is a phenolsulfonic acid or alkali metal salt thereof. Preferably, the phenols comprise, in addition to the sulfonic acid or salt thereof, a sulfone, for example, dihydroxy aromatic diphenol sulfone. Such condensation products contain in addition to sulfonic acid groups or alkali metal salts thereof sulfone groups, i.e.,

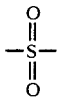

groups. Condensation products of this type are commercially available, for example, Intratex N and Erional PA. A preferred condensation product is the condensation product of formaldehyde with a mixture consisting essentially of an alkali metal salt of para-phenol sulfonic acid and 4,4'-diphenolsulfone in mole ratio ranging from 3:1 to 1:3, sulfone to sulfonic acid.

As a practical matter, condensation products useful for practicing the processs of the present invention are those prepared from relatively inexpensive, commercially available monomers such as phenol, diphenolsulfone, formaldehyde, ortho- and paraphenolsulfonic acids or salts thereof, and mono- and disulfonated diphenolsulfones or salts thereof. Examples of such salts include the ammonium, sodium, potassium or lithium salts thereof. Instead of or in addition to formaldehyde another aldehyde, such as, furfuraldehyde or benzaldehyde may be used. Also, instead of or in addition to a phenol or phenols a corresponding naphthol or naphthols may be used, for example, instead of sodium phenolsulfonate, sodium naphthol sulfonate may be used.

Typically, a sufficient amount of the silicate is an amount at least equivalent in weight to the amount of condensation product added to liquor. If less than an equivalent weight amount is added, the resulting stain resistance of the carpet is diminished. On the other hand, no apparent benefit is gained by adding the silicate in amounts in excess of an equivalent amount.

Silicates which may be used in practicing the improvement of the invention are of the formula $M_2O.m(SiO_2)$ where M is an alkali metal and m is a number ranging from about 0.5 to 2.0. Preferably the silicate is a sodium silicate and most preferably sodium meta silicate (i.e. where M is sodium and m is 1.0). It has been found that the stain resistance imparted to the carpet is greatest when m is 1.0 and diminishes when m is less than or greater than 1.0. It will be understood that the silicate may contain water of hydration, for example, $Na_2O\ SiO_2\ 9H_2O$ ($Na_2SiO_3\ 9H_2O$).

The process of the present invention may be used to impart stain resistance to any carpet having a pile consisting essentially of polyamide fibers. Polyamide fibers of major commercial importance for use in making carpet pile are those shaped from nylon and, especially, those shaped from nylon 66 which is polyhexamethylene adipamide and those shaped from nylon 6 which is polycaprolactam. Other polyamides from which the fibers may be shaped include: nylon 11 which is the polymer of 11-amino undecanoic acid; nylon 610 which is polyhexamethylene sebacamide; and copolymers of nylon 66 of nylon 6 in which a portion of the nylon 66 or nylon 6 monomers are replaced by other monomers copolymerizable therewith, for example, a nylon 66/6 copolymer or nylon 66/6TA copolymer where 6TA is hexamethylene terephthalamide.

STAIN RESISTANCE TEST

The following test procedure is used to determine if polyamide carpet is stain resistant within the meaning of the term as used herein.

A 5 cm×5 cm sample of carpet is immersed in an aqueous solution of FD&C Red Dye No. 40 in which the concentration of the dye is 0.054 gms/liter. The carpet sample is left immersed in the solution for one hour. The sample is then removed from the solution and washed with tap water. If the sample is not stained by the dye, it is stain resistant within the meaning of the term as used herein.

The following example is given to further illustrate the invention.

EXAMPLE

In this example cut pile tufted carpets were prepared from polyamide fibers and treated in accordance with the improvement of the present invention. The treated carpets were then tested to evaluate their resistance to staining.

A 310 filament, 60 denier per filament (dpf), undrawn nylon 66 yarn was prepared by conventional procedures. Fifty-four (54) such yarns were combined to form a tow having a total denier of about 1,000,000. The tow was drawn over rolls to provide nominal 18 dpf tow, crimped in a conventional stuffer box and cut into 7½ inch (19.05 cm) staple. The staple was carded, drafted and spun on a conventional ring spinning frame to provide a 2½ cotton count yarn having about 4.5 tpi (177 tpm) of twist in the Z-direction. Two of these yarns were plied on a conventional ring twister to provide a plied yarn having a net twist of 0 tpi in the Z-direction and 3 tpi (118 tpm) in the S-direction. The resulting plied yarn was then heatset. Two cut pile tufted carpets were made from the heatset plied staple yarn. One carpet (Carpet A) was dyed to a light gold color in accordance with the improvement of the invention in a conventional continuous dyeing range of the type described above. The carpet was prewetted with water. Then, liquor was sprayed onto the carpet. The liquor ratio was 2:1. The liquor contained sodium meta silicate and Intratex N in a weight ratio of 1:1. (Analysis of Intratex N indicated it to be a condenstion product of formaldehyde with phenolsulfonic acid and 4,4'-diphenol sulfone.) Sufficient Intratex N was present to provide 0.4% by weight, based on the weight of pile fibers. The pH of the liquor was 4.5. The carpet was then passed through a festoon steamer. The residence time of the carpet in the steamer was from 3 to 5 minutes. The carpet was then washed with water to remove residual dye and dried in an oven. Light gold was selected as being a color which contrasts well with most stains. The other carpet (Carpet B) was dyed in an identical manner except in this instance, the Intratex N and silicate were omitted from the liquor.

Carpet A (invention) and Carpet B (control), were then sheared (i.e., defuzzed) and used in conducting the following tests.

TEST A

A 5 cm×5 cm sample of Carpet A (invention) and of Carpet B (control) were each subjected to the Stain Resistance Test, described previously herein. Carpet A was then cleaned using a heavy duty carpet cleaning unit commercially available under the tradename "Streamex". (Steamex equipment and supplies are manufactured by U.S. Floor System, Inc., Raleigh, N.C.). The unit resembles a typical vacuum cleaner except it has means for spraying a liquid onto the carpet just ahead of the suction nozzle of the unit. The liquid sprayed onto the carpet was a hot water solution of a non-ionic detergent. The detergent was that recommended by distributors for use with Steamex units. The liquid was sprayed onto the carpet with sufficient force so as to cause the liquid to penetrate into the pile. Liquid was immediately removed by the suction nozzle of the unit. A 5 cm×5 cm sample of Carpet A, once cleaned, was then subjected to the Stain Resistance Test. This procedure was repeated until five cleaning—testing cycles had been completed. The results of the tests are given below.

TABLE I

| Samples | Cleaning Cycles | Stained | Comments |
|---|---|---|---|
| Control | None | Yes | Bright Red |
| Invention | None | No | No Visible Stain |
| Invention | 1 | No | No Visible Stain |
| Invention | 2 | No | No Visible Stain |
| Invention | 3 | No | No Visible Stain |
| Invention | 4 | Yes | Slight Tint of Pink |
| Invention | 5 | Yes | Slight Tint of Pink |

The results of this test clearly illustrate the stain resistant characteristics of polyamide carpets dyed in accordance with the improvement of the present invention. Note that the stain resistance imparted to the carpet samples in accordance with the improvement of the present invention is of a permanent nature, as evidenced by the fact that the stain resistance of the carpet survives three commercial cleanings.

TEST B

Samples of Carpet A (invention) and Carpet B (control) were subjected to the common household liquid substances listed in the table below to determine the resistance of the samples to staining by colorants present in these substances. Each substance was applied and rubbed into the carpet. The carpet was then blotted with paper towels to remove excess substance from the carpet. The next day the sample was washed, first with a dilute water solution of a commercial detergent and then with water, to remove to the extent possible all remaining substance from the sample.

TABLE II

| | Staining Results | |
|---|---|---|
| | Carpet Samples | |
| Substance | Invention | Control |
| Coffee/Cream/Sugar | Removed | Stained |
| Cola | Removed | Removed |
| Red Wine | Removed | Stained |
| Watercolor | Removed | Removed |
| Mustard w/Turmeric | Stained | Stained |
| Mustard w/out Turmeric | Removed | Removed |
| Soft Drink w/FD & C Red Dye No. 40* | Removed | Stained |

*soft drink is prepared by dissolving soft drink premix ingredients in a specified amount of water.

The results in the Table clearly show that carpet dyed in accordance with the improvement of the invention has resistance to staining when compared to carpet dye in a corresponding manner but without the benefit of the improvement of the invention.

TEST C

In Test B, the substance which most severely and permanently stained the untreated carpet samples was the soft drink (cherry flavored) containing FD&C Red Dye No. 40 in a concentration of 0.054 gms/liter. A separate test was conducted to determine the effect of a massive spill of the soft drink on a sample of the treated carpet. In this test, one gallon (3785 ml) of the soft drink was poured onto an appropriate sized carpet from a gallon milk container, the container being held at a height of one meter above the face of the carpet sample. The soft drink was allowed to soak into the carpet. The carpet was then blotted with paper towels to remove excess soft drink. No steps were taken to clean the carpet or remove any of the soft drink until the next day. The next day the carpet sample was cleaned in the manner described above in Test B. Surprisingly, after being cleaned, no visible evidence of the soft drink (FD&C Red Dye No. 40) remained on the carpet sample.

Similar results are obtained when Erional PA and Erional NW condensation product is substituted for Intratex N condensation product in the finish.

TEST D

Fiber samples taken from Carpet A (invention) and Carpet B (control) were tested to determine the ability of the fibers to resist staining by the above soft drink. In these experiments, the light absorption of a weighed amount of soft drink containing FD&C Red Dye No. 40 was measured on a Cary 15 Spectrophotometer using a ½ cm cell with the light absorption being measured at 520 millimicrons. (Light absorption is a measure of dye concentration of the drink.) The drink was prepared as before according to the instructions on the package containing the premix ingredients. The light absorption reading was recorded as $T_0$. The soft drink was put into a stoppered container with a sufficient amount of fiber sample to provide a weight ratio of drink to fiber of 40:1. The stoppered container of drink and fiber was then shaken on a motorized shaker for a period of two hours. The fiber was then removed from the container and the light absorption of the drink was determined as before. The reading this time was recorded as $T_1$. (If the fiber sample did not resist staining, i.e., took up dye from the drink, the $T_1$ value was less than the $T_0$ value; on the other hand, if the fiber sample resisted staining, i.e. took up no dye, the $T_0$ and $T_1$ were the same.) In order to compare samples the test results were expressed as a change in light penetration, expressed as a percentage, calculated as follows:

$$\% = \frac{T_0 - T_1}{T_0} \times 100$$

The lower the precentage, the more resistant the yarn was to staining. In these experiments, fiber samples taken from carpets treated in accordance with the present invention gave test values ranging from 0 to 1.0%, whereas fibers taken from control carpets gave test values ranging from 30 to 35%.

TEST E

In related experiments carpet samples were made and dyed using the procedure described in Example 1 for making Carpet A except in certain of the experiments the sodium silicate was omitted from the liquor, in other of the experiments the condensation product was omitted, and in still others of the experiment sodium silicates other than sodium meta silicate were used. In the experiments in which either the silicate or condensation product was omitted from the liquor stain resistant carpets were not obtained. In the experiments in which different silicates were used, it was observed that as the ratio of $Na_2O$ to $SiO_2$ increased or decreased from 1.0, the stain resistance of the resulting carpets diminished until the ratio was less than 0.5 or greater than 2.0 at which point the resulting carpets were no longer stain resistant within the meaning of the terms as used herein.

What we claim is:

1. In a process for continuously dyeing a carpet having a pile consisting essentially of polyamide fibers wherein an endless length of the carpet is passed through a treating zone in which the carpet is first prewetted, then treated with an aqueous dye liquor wherein the liquor ratio is in the range of 1.5:1.0 to 4.5:1.0, then, subjected to an atmosphere of steam to fix the dye on the carpet, then washed with water to remove residual liquor from the carpet and, finally, dried, the improvement of imparting stain resistance to the carpet comprising adding a silicate of the formula $M_2O.mSiO_2$ and either a sulfonated phenol-formaldehyde condensation product or a sulfonated naphthol-formaldehyde condensation product or mixtures thereof to the liquor each in an amount sufficient in combination to impart stain resistance to the carpet, where M is an alkali metal and m is a number ranging from about 0.5 to 2.0.

2. The process of claim 1 wherein the condensation product contains sulfone groups.

3. The process of claim 2 wherein said silicate is a sodium silicate.

4. The process of claim 3 wherein at least one of the phenols is phenolsulfonic acid or an alkali metal salt thereof.

5. The process of claim 1 wherein said condensation product is the condensation product of formaldehyde and a mixture of phenols consisting essentially of a phenolsulfonic acid or an alkali metal salt thereof and a diphenol sulfone.

6. The process of claim 5 wherein the mole ratio of said sulfonic acid or salt thereof to said sulfone phenols is in the range of 1:3 to 3:1.

7. The process of claim 5 wherein the weight ratio of said silicate to condensation product is at least 1:1.

8. The process of claim 5 wherein said the dye liquor contains a sufficient amount of condensation product to provide at least 0.1% by weight thereof, based on the weight of said fibers.

9. The process of claim 5 wherein said silicate is sodium meta silicate.

10. The process of claim 5 wherein said fibers are nylon 66 fibers.

* * * * *

UNITED STATES PATENT AND TRADEMARK OFFICE

CERTIFICATE OF CORRECTION

PATENT NO. : 4,501,591

DATED : February 26, 1985

INVENTOR(S) : Pompelio A. Ucci et al.

It is certified that error appears in the above-identified patent and that said Letters Patent is hereby corrected as shown below:

Column 5, line 2, after "of" insert -- cherry flavored soft drink premix containing --.

Signed and Sealed this

Twenty-third Day of December, 1986

*Attest:*

DONALD J. QUIGG

*Attesting Officer* *Commissioner of Patents and Trademarks*